US011814780B2

(12) United States Patent
Rangu et al.

(10) Patent No.: US 11,814,780 B2
(45) Date of Patent: Nov. 14, 2023

(54) LAUNDRY APPLIANCE INCLUDING INDUCTION IRONING ASSEMBLY

(71) Applicant: Haier US Appliance Solutions, Inc., Wilmington, DE (US)

(72) Inventors: Venkata Chakradhar Rangu, Louisville, KY (US); Neki Jashwant Patel, Hyderabad (IN); Neelapala Gopinath Yadav, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/371,193

(22) Filed: Jul. 9, 2021

(65) Prior Publication Data

US 2023/0009155 A1 Jan. 12, 2023

(51) Int. Cl.

| | |
|---|---|
| ***D06F 58/20*** | (2006.01) |
| ***D06F 60/00*** | (2009.01) |
| ***D06F 75/24*** | (2006.01) |

(52) U.S. Cl.

CPC ..... *D06F 58/203* (2013.01); *D06F 60/00* (2013.01); *D06F 75/243* (2013.01)

(58) Field of Classification Search

CPC ..... D06F 58/203; D06F 58/20; D06F 60/00; D06F 75/24; D06F 75/243

See application file for complete search history.

(56) References Cited

U.S. PATENT DOCUMENTS

| | | | | |
|---|---|---|---|---|
| 1,594,158 | A * | 7/1926 | Else | D06F 67/08 219/512 |
| 2,761,941 | A * | 9/1956 | Ardichvili | H05B 6/145 219/601 |
| 4,268,737 | A * | 5/1981 | Paschakarnis | D06F 81/08 219/650 |
| 7,681,342 | B2 | 3/2010 | Choi | |
| 10,774,461 | B2 | 9/2020 | Kim et al. | |
| 10,774,464 | B2 | 9/2020 | Bensel et al. | |

FOREIGN PATENT DOCUMENTS

| | | | |
|---|---|---|---|
| CN | 202323510 | U | 7/2012 |
| FR | 2760761 | A1 | 9/1998 |
| WO | WO-8803579 | A1 * | 9/1988 |

* cited by examiner

*Primary Examiner* — Ismael Izaguirre
(74) *Attorney, Agent, or Firm* — Dority & Manning, P.A.

(57) ABSTRACT

A laundry appliance includes a cabinet, a drum rotatably mounted within the cabinet for receipt of clothes, and an integrated ironing assembly including an induction coil assembly positioned within the cabinet, such as below a top panel of the cabinet, and being selectively energized to generate a magnetic field for heating an ironing tool, such as a ferromagnetic ironing plate, when the ironing tool is positioned within the magnetic field generated by the induction coil assembly.

19 Claims, 5 Drawing Sheets

LAUNDRY APPLIANCE INCLUDING INDUCTION IRONING ASSEMBLY

FIELD OF THE INVENTION

The present subject matter relates generally to laundry appliances, and more particularly to ironing assemblies integrated into laundry appliances.

BACKGROUND OF THE INVENTION

Laundry appliances generally include a cabinet with a drum rotatably mounted therein for cleaning and/or drying articles of clothing. For example, washing machine appliances include a wash tub filled with a wash fluid and a wash basket rotatably mounted within the wash tub and being selectively rotated by a motor to agitate clothes within a wash basket to facilitate a cleaning process. A dryer appliance typically includes a drum that rotates to tumble clothes in the presence of heated air to facilitate a drying process on the clean clothes. After the dryer operation is complete, the cleaned and dried clothes may be removed from the dryer appliance to wear or store for future use.

Notably, ironing boards and clothes irons are commonly used to press and iron cleaned and dried clothes, e.g., to remove wrinkles prior to storage or use. More specifically, ironing boards are often standalone devices with a flat surface for supporting clothes while a separate iron may be plugged into a wall outlet to generate heat to facilitate the ironing process. However, some users find it inconvenient to pull out a large ironing board and find an additional outlet to energize the iron. Moreover, a separate ironing location is often needed to stage clothes prior to and after ironing, e.g., due to space limitations within a laundry room. As such, users must typically put all of the dried clothes in a laundry basket and transport the basket to the ironing location, resulting in more wrinkles and compressed clothes during the process.

Accordingly, a laundry appliance with features for facilitating an ironing process on clothes would be desirable. More specifically, a washing machine or dryer appliance that includes integrated features for ironing clothes without requiring a separate ironing board and electrical outlets would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a laundry appliance is provided including a cabinet, a drum rotatably mounted within the cabinet, the drum defining a chamber for receipt of clothes, and an ironing assembly. The ironing assembly includes an induction coil assembly positioned within the cabinet and being selectively energized to generate a magnetic field and an ironing tool that heats up when placed within the magnetic field generated by the induction coil assembly.

In another exemplary embodiment, an ironing assembly positioned below a top panel of a laundry appliance is provided. The ironing assembly includes an induction coil assembly positioned below the top panel and being selectively energized to generate a magnetic field and an ironing tool that heats up when placed within the magnetic field generated by the induction coil assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
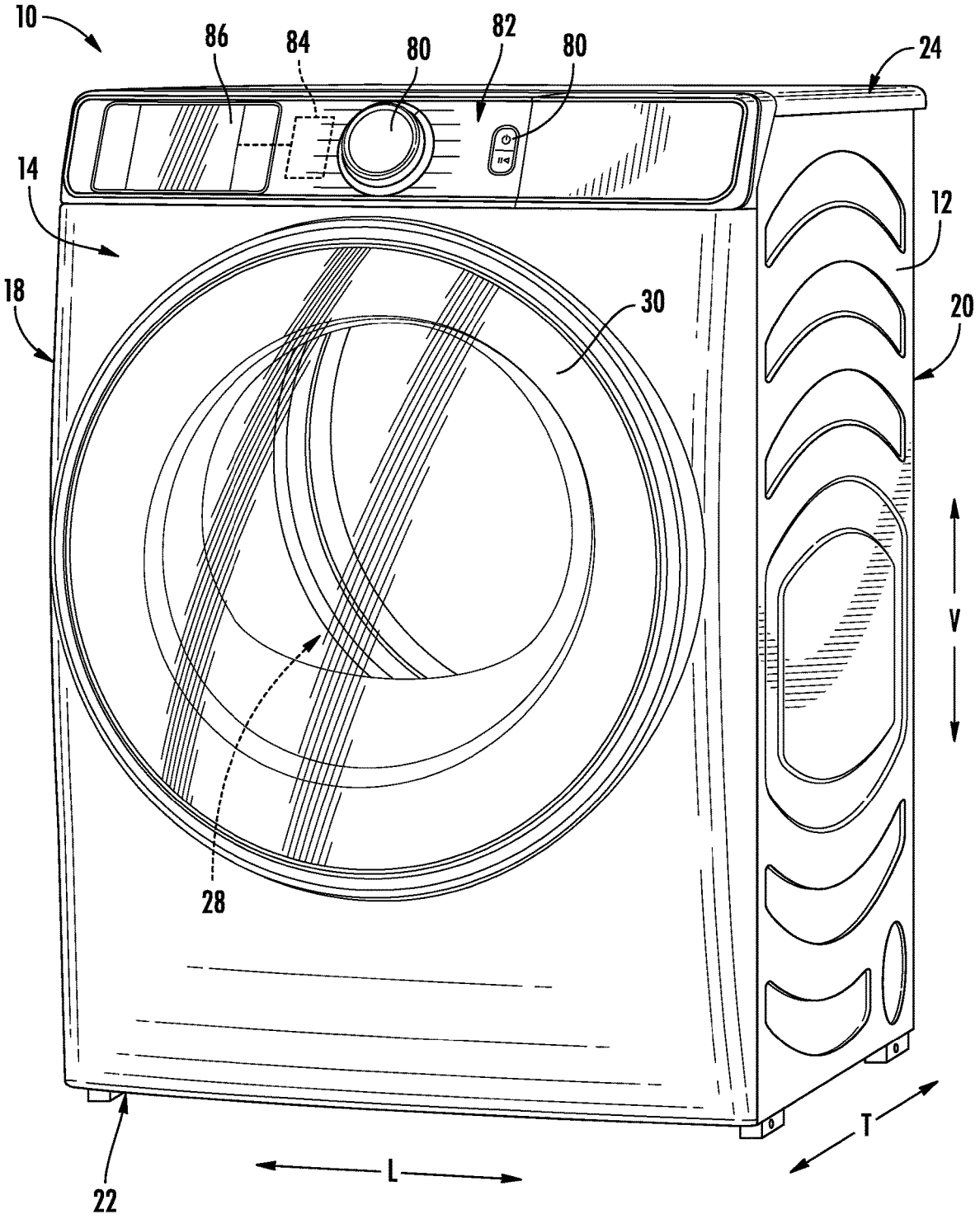
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged.

Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
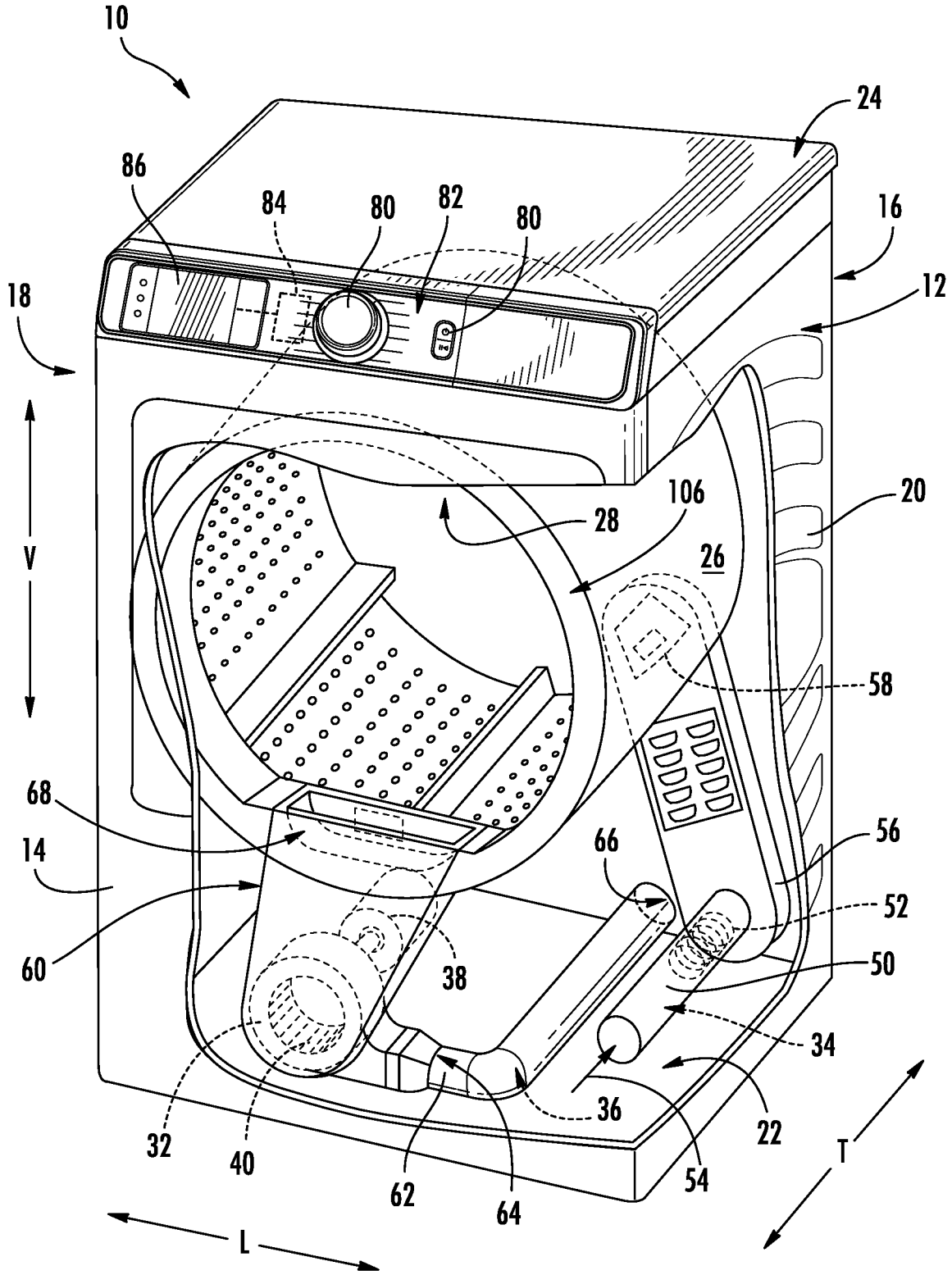
FIG. 2 provides a perspective view of the exemplary dryer appliance of FIG. 1 with portions of a cabinet of the exemplary dryer appliance removed to reveal certain components of the exemplary dryer appliance.
Figure 3:
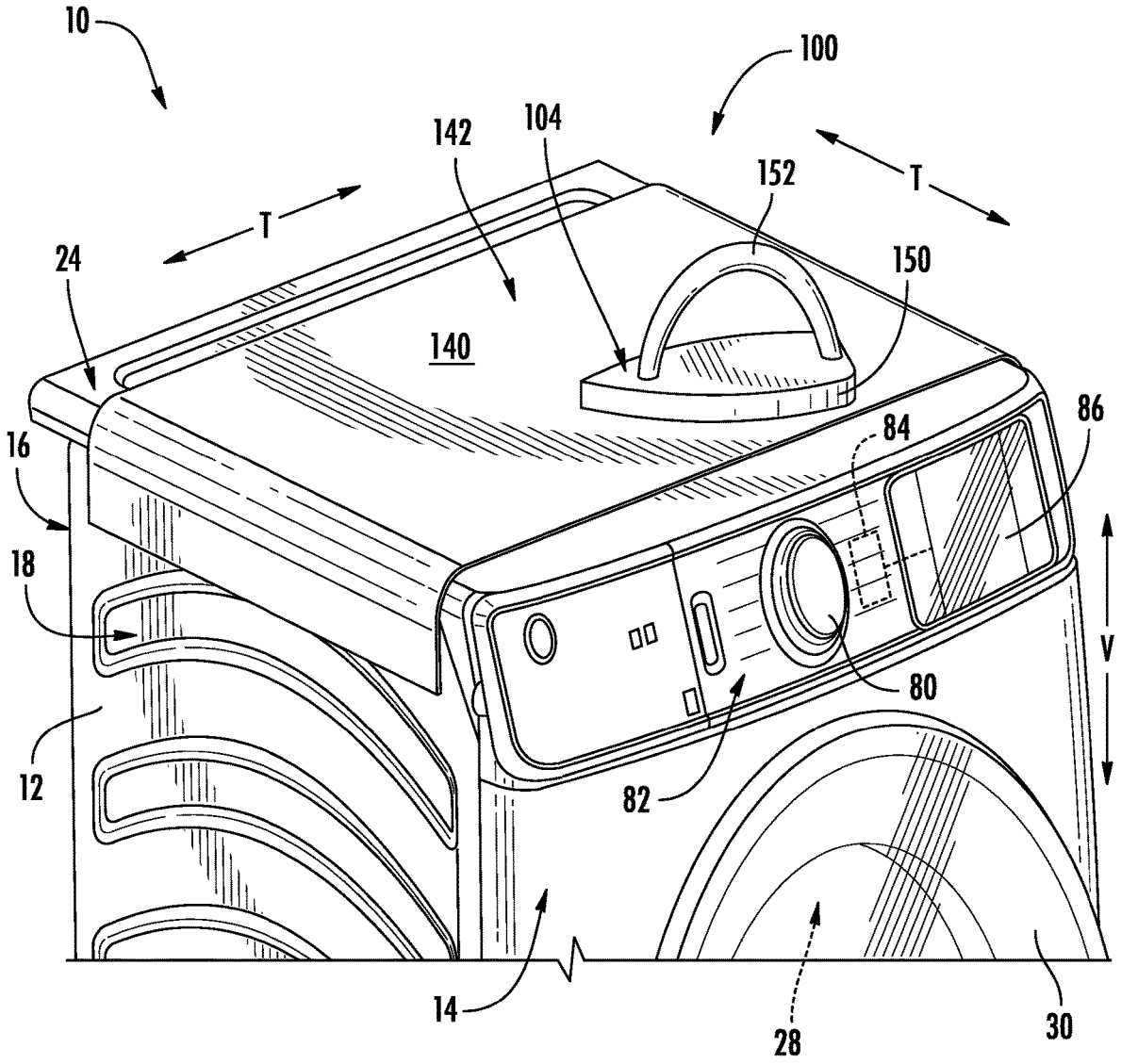
FIG. 3 provides a perspective view of an ironing system that may be used with the exemplary dryer appliance of FIG. 1 according to an exemplary embodiment of the present subject matter.

Referring now to the figures, FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances, washing machine appliance, or laundry appliances having different appearances and different features may also be utilized with the present subject matter as well.

According to exemplary embodiments, dryer appliance 10 includes cabinet 12 that is generally configured for containing and/or supporting various components of dryer appliance 10 and which may also define one or more internal chambers or compartments of dryer appliance 10. In this regard, as used herein, the terms "cabinet," "housing," and the like are generally intended to refer to an outer frame or support structure for dryer appliance 10, e.g., including any suitable number, type, and configuration of support structures formed from any suitable materials, such as a system of elongated support members, a plurality of interconnected panels, or some combination thereof. It should be appreciated that cabinet 12 does not necessarily require an enclosure and may simply include open structure supporting various elements of dryer appliance 10. By contrast, cabinet 12 may enclose some or all portions of an interior of cabinet 12. It should be appreciated that cabinet 12 may have any suitable size, shape, and configuration while remaining within the scope of the present subject matter.

As illustrated, dryer appliance 10 generally defines a vertical direction V, a lateral direction L, and a transverse direction T, each of which is mutually perpendicular, such that an orthogonal coordinate system is generally defined. Cabinet 12 includes a front panel 14 and a rear panel 16 spaced apart along the transverse direction T, a pair of side panels 18 and 20 spaced apart from each other along the lateral direction L (e.g., extending between front panel 14 and rear panel 16), and a bottom panel 22 and a top panel 24 spaced apart along the vertical direction V.

Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of inlet duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a user interface panel 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet user interface panel 82. Display 86 may be in communication with controller 84 and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Referring now also generally to FIGS. 3 through 6, an exemplary ironing assembly 100 that may be used with dryer appliance 10 will be described according to exemplary embodiments of the present subject matter. In general, ironing assembly 100 may be integrated into dryer appliance 10 to provide a quick, easy, and space conserving solution for common clothes ironing issues. For example, ironing assembly 100 eliminates the need for a separate ironing board, a place to set up the ironing board, and the necessity of transporting dried clothes to the ironing board. In addition, ironing assembly 100 eliminates the need for a corded clothes iron, a dedicated electrical outlet for plugging in the clothes iron, etc.

Other advantages of ironing assembly 100 will be apparent to those having ordinary skill in the art. In addition, it should be appreciated that the benefits of ironing assembly 100 may be translated or applied in other appliances as well, such as a washing machine appliance. Exemplary embodiments of ironing assembly 100 will be described below, specifically with reference to FIGS. 3 through 6. It should be appreciated that aspects of these various embodiments may be interchangeable and may be modified in any suitable manner while remaining within the scope of the present subject matter.

As illustrated, ironing assembly 100 generally includes an induction coil assembly 102 that is positioned within cabinet 12 and is selectively energized to generate a magnetic field. Specifically, induction coil assembly 102 may generally include one or more induction coils or induction heating element generally configured for generating an electromagnetic field when supplied with a high-frequency alternating current. In addition, ironing assembly 100 includes an ironing tool 104 that heats up when placed within the magnetic field generated by induction coil assembly 102. As such, induction coil assembly 102 may be selectively energized (e.g., under regulation of controller 84) to generate a magnetic field to heat ironing tool 104 when the user wishes to perform an ironing operation. As illustrated for example in FIGS. 4 through 6, induction coil assembly 102 may include various power electronics or electronic components 106 that are in operative communication with controller 84 and are generally configured for regulating the operation of induction coil assembly 102.

In general, induction coil assembly 102 may be positioned at any suitable location within cabinet 12 suitable for generating a magnetic field for heating ironing tool 104. For example, according to the illustrated embodiments, cabinet 12 is formed at least partially from top panel 24 and induction coil assembly 102 is positioned within cabinet 12 below top panel 24. More specifically, according to the illustrated embodiment, induction coil assembly 102 may be mounted directly to a bottom side 110 of the top panel 24, e.g., via one or more mounting brackets 112. In this manner, a user may heat ironing tool 104 by placing ironing tool 104 on top of cabinet 12, e.g., directly on top panel 24 over induction coil assembly 102. When so positioned, induction coil assembly 102 may be operated to generate the magnetic field for heating ironing tool 104. The heated ironing tool 104 may then be used to iron clothes directly on top panel 24.

However, it should be appreciated that the illustrated positioning and configuration of ironing assembly 100 is only exemplary and is not intended to limit the scope of the present subject matter in any manner. In this regard, for example, induction coil assembly 102 may be positioned at other suitable locations on dryer appliance 10. In this regard, for example, induction coil assembly 102 may be positioned on a side wall or side panel 18, 20 of cabinet 12. In this regard, for example, a support bracket (not shown) for ironing tool 104 may be mounted to side panel 20 for receiving ironing tool 104. More specifically, ironing tool 104 may be positioned directly adjacent induction coil assembly 102 when seated within the support bracket. In this manner, induction coil assembly 102 may be operated to selectively heat ironing tool 104 when an ironing procedure is about performed. Other suitable positions for induction coil assembly 102 and ironing tool 104 storage are possible and within the scope of the present subject matter.

Figure 6:
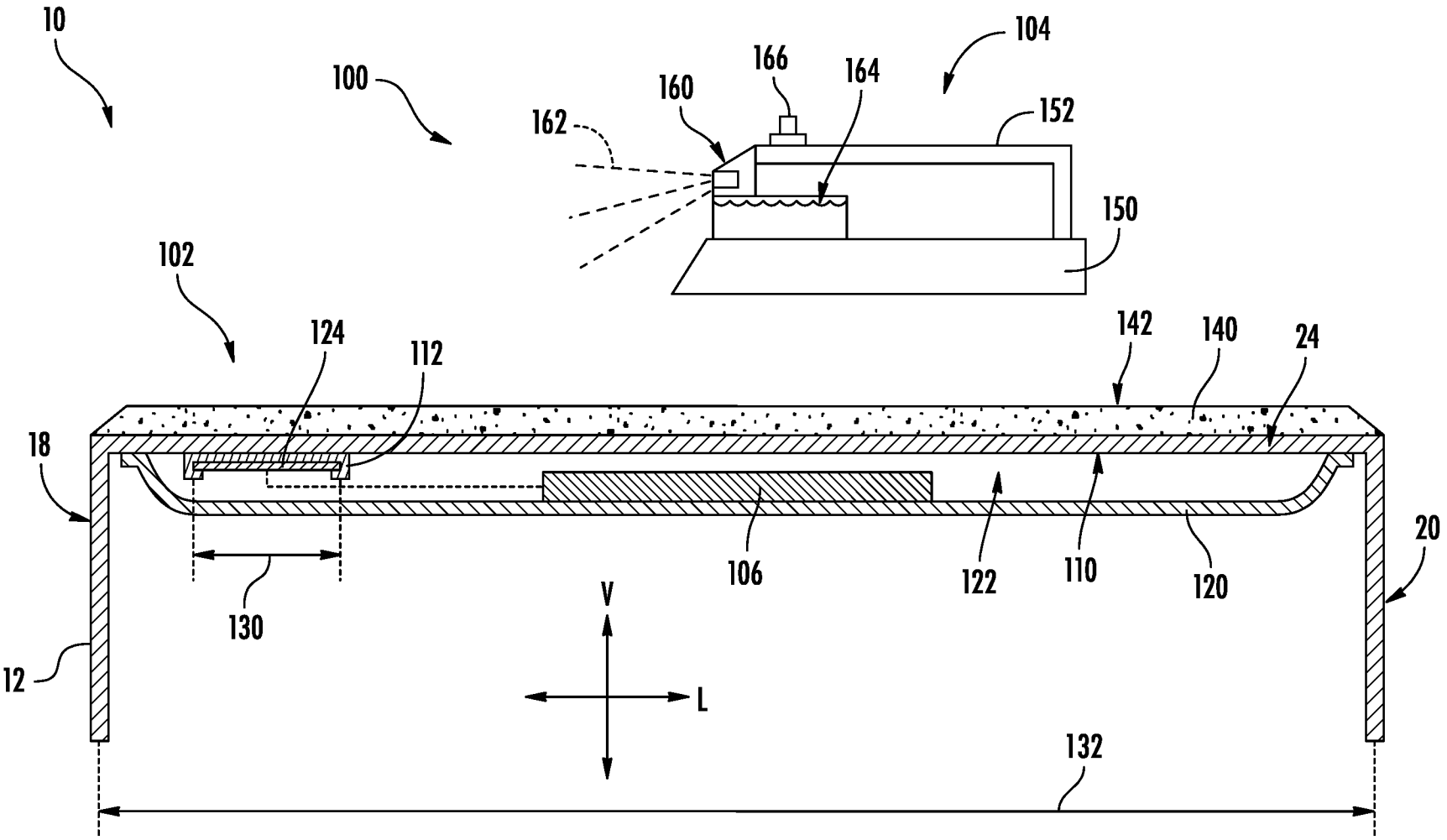
FIG. 6 provides a front, cross-sectional view of the exemplary ironing system of FIG. 3 according to another exemplary embodiment of the present subject matter.

According to the illustrated embodiment (e.g., as best shown in FIG. 6), ironing assembly 100 may further include a coil housing 120 that is spaced apart from top panel 24 along the vertical direction V to define an enclosure 122. In general, induction coil assembly 102, electronic components 106, and any other suitable components or devices may be positioned within enclosure 122. In general, coil housing 120 may be a flat, insulative, and nonferromagnetic material that is suitable for protecting and supporting components of ironing assembly 100.

Figure 4:
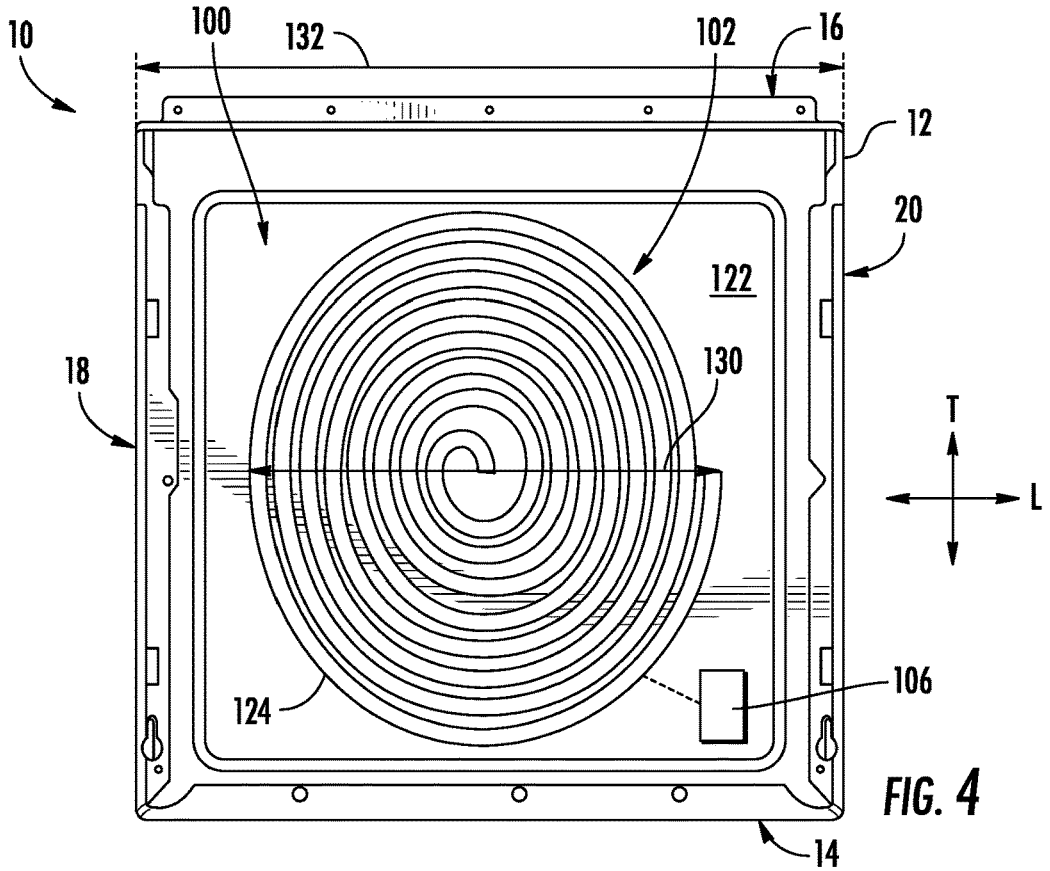
FIG. 4 provides a top view of the exemplary ironing system of FIG. 3 with a cabinet of the dryer appliance removed according to an exemplary embodiment.

Notably, induction coil assembly 102 may include any suitable number, type, size, and configuration of induction coils 124 suitable for generating electromagnetic fields for heating ironing tool 104. For example, according to each illustrated embodiment, induction coil assembly 102 includes a single induction coil 124. More specifically, as shown in FIG. 4, induction coil assembly 102 includes a single large induction coil 124 that is centered proximate a central point of top panel 24 along the lateral direction L and the transverse direction T. In this manner, positioning ironing tool 104 at any location on top panel 24 should result in heating of ironing tool 104 by the electromagnetic field generated by induction coil assembly 102.

Figure 5:
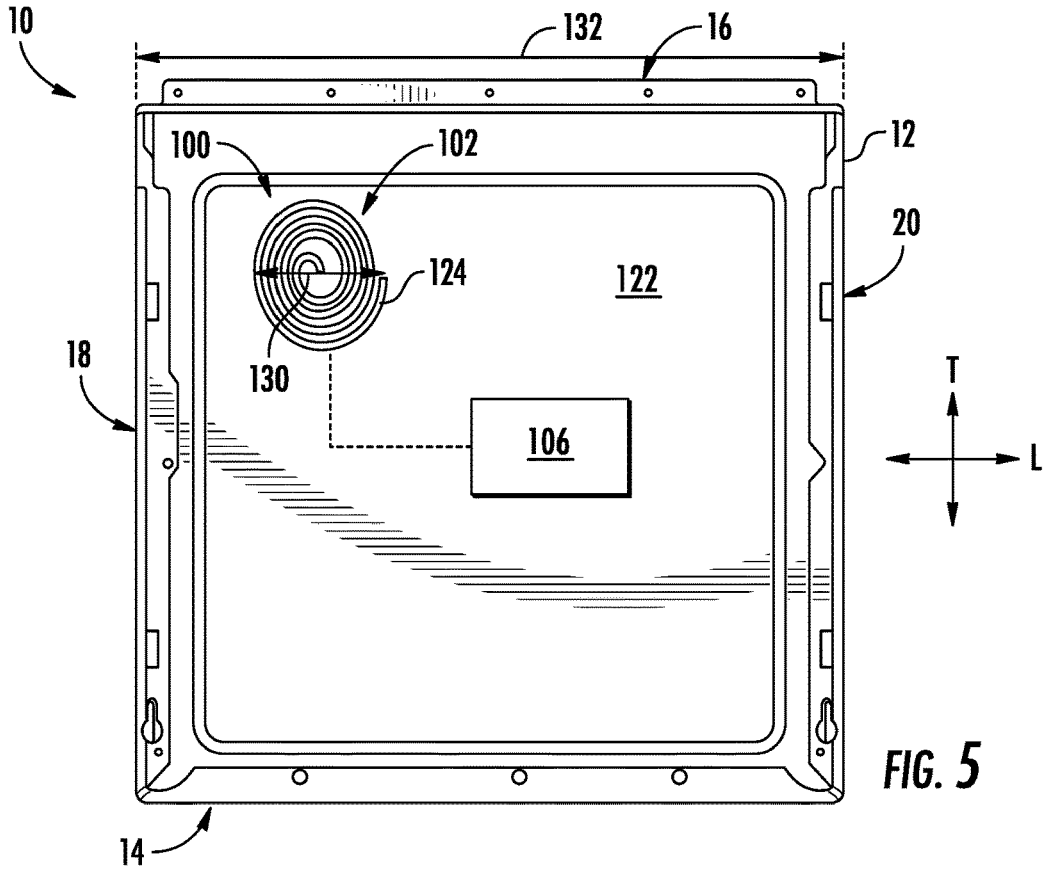
FIG. 5 provides a top view of the exemplary ironing system of FIG. 3 with a cabinet of the dryer appliance removed according to another exemplary embodiment.

By contrast, FIGS. 5 and 6 illustrate an alternative embodiment where induction coil 124 is localized within and a rear corner of top panel 24. In this regard, induction coil 124 is smaller and is positioned proximate a corner defined by rear panel 16 and one of side panels 18, 20. Notably, the small, localized induction coil may help conserve energy but may require that the user periodically place ironing tool 104 on or over induction coil 124 to keep ironing tool 104 suitably heated to perform an ironing operation. It should be appreciated that the size, position, and configuration of induction coils 124 as described herein are only exemplary and not intended to limit the scope of the present subject matter in any manner.

For example, induction coil 124 may generally define an average width or an average diameter 130, e.g., as measured in a horizontal plane defined by the lateral direction L and the transverse direction T. Similarly, top panel 24 may define a top panel width 132 is measured along the lateral direction L (e.g., from side panel 18 to side panel 20). As shown in FIG. 4, induction coil 124 takes up a large cross-sectional area of top panel 24, such that average diameter 130 is greater than 50%, greater than 60%, greater than 70%, greater than 80%, greater than 90%, or greater, of top panel width 132. By contrast, as shown in FIGS. 5 and 6, average diameter 130 may be less than about 50%, less than about 40%, less than about 30%, less than about 20%, or less than about 10%, or less, of top panel width 132. Other sizes, shapes, and positions, of induction coil 124 are possible and within scope the present subject matter. For example, according to alternative embodiments, induction coil 124 need not be circular and all and may have other suitable shapes, such as rectangular, oval, etc.

Notably, due to the magnetic field generated by induction coil assembly 102, top panel 24 may generally be formed from a nonferromagnetic plate. For example, according to an exemplary embodiment, top panel 24 is formed from stainless steel, though other suitable materials are possible and within the scope of the present subject matter. In this manner, top panel 24 does not have a tendency to heat up when induction coil assembly 102 generates the magnetic field. In addition, it may be desirable to have a soft surface upon which clothes may be ironed. Thus, as best illustrated in FIG. 6, ironing assembly 100 may further include a padded cover 140 that is positioned on top panel 24 to define an ironing surface 142. Notably, the soft padded cover 140 facilitates improved ironing performance while still permitting induction coil assembly 102 to heat up ironing tool 104.

As best illustrated in FIG. 6, ironing tool 104 is generally a separate component from dryer appliance 10 which may be moved about, e.g., particularly relative to top panel 24 and ironing surface 142. Notably, according to exemplary embodiments, ironing tool 104 may include a ferromagnetic plate 150, which is typically suited to generating heat the presence of a magnetic field. In this regard, for example, ferromagnetic plate 150 may generally be constructed of a ferrous material such as iron, an iron alloy, or any other suitable material that generates heat in the presence of an electromagnetic field. In addition, in order to prevent burns to a user of ironing tool 104, ironing tool 104 may include a thermally insulated handle 152. In this manner, ironing tool 104 may be heated and manipulated by a user without risking burns to the user.

Referring still to FIG. 6, ironing tool 104 may further include a spraying assembly 160 that is generally configured for discharging water or a mist (e.g., as is indicated generally by reference numeral 162) onto clothes during the ironing process. Furthermore, ironing tool 104 may include a water tank 164 which may be filled with water or another fluid which may be selectively discharged by spraying assembly 160. In addition, as illustrated, ironing tool 104 may include a button 166 that may be pressed to selectively discharge mist 162 through spraying assembly 160. For example, button 166 is illustrated as being positioned on top of insulated handle 152. Other configurations and components may be included on ironing tool 104 while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A laundry appliance comprising:

a cabinet;

a drum rotatably mounted within the cabinet, the drum defining a chamber for receipt of clothes; and an ironing assembly comprising:

an induction coil assembly positioned within the cabinet and being selectively energized to generate a magnetic field; and an ironing tool that heats up when placed within the magnetic field generated by the induction coil assembly.

2. The laundry appliance of claim 1, wherein the cabinet comprises a top panel, wherein the induction coil assembly is positioned within the cabinet below the top panel.

3. The laundry appliance of claim 2, wherein the induction coil assembly is mounted to a bottom side of the top panel.

4. The laundry appliance of claim 2, wherein the induction coil assembly defines an average diameter and the top panel defines a top panel width, wherein the average diameter is less than about 30 percent of the top panel width.

5. The laundry appliance of claim 2, wherein the induction coil assembly defines an average diameter and the top panel defines a top panel width, wherein the average diameter is greater than about 70 percent of the top panel width.

6. The laundry appliance of claim 1, wherein the induction coil assembly is localized within a rear corner of a top panel.

7. The laundry appliance of claim 1, wherein a top panel is formed from a non-ferromagnetic plate.

8. The laundry appliance of claim 7, wherein the top panel is formed from stainless steel.

9. The laundry appliance of claim 1, wherein the ironing tool is a ferromagnetic plate.

10. The laundry appliance of claim 1, wherein the ironing tool comprises an insulated handle.

11. The laundry appliance of claim 1, wherein the ironing tool comprises a water tank and spraying assembly.

12. The laundry appliance of claim 1, wherein the ironing assembly further comprises:

a coil housing spaced apart from a top panel to define an enclosure, the induction coil assembly and control electronics being positioned within the enclosure.

13. The laundry appliance of claim 1, wherein the ironing assembly further comprises:

a padded cover positioned on a top panel of the laundry appliance to define an ironing surface.

14. The laundry appliance of claim 1, wherein the laundry appliance is a washing machine appliance.

15. The laundry appliance of claim 1, wherein the laundry appliance is a dryer appliance.

16. An ironing assembly positioned below a top panel of a laundry appliance, wherein the top panel is formed from a non-ferromagnetic stainless steel plate, the ironing assembly comprising:

an induction coil assembly positioned below the top panel and being selectively energized to generate a magnetic field; and an ironing tool that heats up when placed within the magnetic field generated by the induction coil assembly.

17. The ironing assembly of claim 16, wherein the induction coil assembly defines an average diameter and the top panel defines a top panel width, wherein the average diameter is less than about 30 percent of the top panel width.

18. The ironing assembly of claim 16, wherein the induction coil assembly defines an average diameter and the top panel defines a top panel width, wherein the average diameter is greater than about 70 percent of the top panel width.

19. The ironing assembly of claim 16, wherein the ironing tool is a ferromagnetic plate and comprises an insulated handle on a top panel of the laundry appliance to define an ironing surface.

* * * * *